US008552318B2

(12) United States Patent
Najera et al.

(10) Patent No.: US 8,552,318 B2
(45) Date of Patent: Oct. 8, 2013

(54) ROTARY INTERLOCK MECHANISM FOR ELECTRICAL SWITCHES

(75) Inventors: Gerardo Rodriguez Najera, San Nicolas de los Garza (MX); Jeffrey O. Sharp, Lexington, KY (US); Raul Sanchez Jimenez, San Nicolas de los Garza (MX)

(73) Assignee: Schneider Electric USA, Inc., Palatine, IL (US)

( * ) Notice: Subject to any disclaimer, the term of this patent is extended or adjusted under 35 U.S.C. 154(b) by 299 days.

(21) Appl. No.: 12/945,117

(22) Filed: Nov. 12, 2010

(65) Prior Publication Data

US 2012/0118716 A1 May 17, 2012

(51) Int. Cl.
*H01H 9/24* (2006.01)

(52) U.S. Cl.
USPC ..... 200/50.35

(58) Field of Classification Search
USPC ..... 200/43.11–43.21, 50.01, 50.32–50.4, 200/318, 321, 322, 334
See application file for complete search history.

(56) References Cited

U.S. PATENT DOCUMENTS

| | | | | | |
|---|---|---|---|---|---|
| 708,724 | A | | 9/1902 | Merrick et al. | |
| RE26,113 | E | * | 11/1966 | Carter et al. | 200/50.34 |
| 3,319,020 | A | | 5/1967 | Shaffer | |
| 3,492,448 | A | | 1/1970 | Phillips, Jr. | |
| 4,295,054 | A | * | 10/1981 | Kovatch et al. | 307/80 |
| 4,328,401 | A | * | 5/1982 | Carr | 200/11 R |
| 4,665,284 | A | * | 5/1987 | Guinan | 200/50.33 |
| 5,648,646 | A | | 7/1997 | Flegel | |
| 5,902,974 | A | | 5/1999 | Fogle et al. | |
| 6,009,328 | A | | 12/1999 | Muszynski | |
| 6,031,193 | A | | 2/2000 | Flegel | |
| 6,043,439 | A | * | 3/2000 | Crooks et al. | 200/50.33 |
| 6,096,986 | A | | 8/2000 | Flegel | |
| 6,137,070 | A | | 10/2000 | Montague et al. | |
| 6,180,897 | B1 | | 1/2001 | Montague et al. | |
| 6,320,143 | B1 | | 11/2001 | Greer | |
| 6,329,615 | B1 | * | 12/2001 | Biquez | 200/43.11 |
| 6,617,533 | B1 | * | 9/2003 | Lawson et al. | 200/50.32 |
| 6,621,689 | B1 | | 9/2003 | Flegel | |
| 6,861,596 | B2 | | 3/2005 | Schnackenberg | |
| 6,927,349 | B1 | | 8/2005 | Flegel et al. | |
| 7,411,139 | B2 | * | 8/2008 | McCoy | 200/50.33 |

OTHER PUBLICATIONS

International Search Report corresponding to co-pending International Patent Application Serial No. PCT/US2011/057026, European Patent Office, dated Jan. 20, 2012; (5 pages).
International Written Opinion corresponding to co-pending International Patent Application No. PCT/US2011/057026, European Patent Office, dated Jan. 20, 2012; (7 pages).

* cited by examiner

*Primary Examiner* — Felix O Figueroa
(74) *Attorney, Agent, or Firm* — Nixon Peabody LLP

(57) ABSTRACT

Rotary switch interlock mechanisms and electrical switch assemblies with a rotary switch interlock mechanism are presented herein. An electrical distribution device with at least two electrical switches is disclosed. Each of the electrical switches has a switch actuator that is movable between engaged and disengaged positions. A rotary interlock member is rotatably mounted to the housing of the electrical distribution device adjacent the first and second electrical switches. The rotary interlock member is rotatable 180 degrees between a first orientation, whereat the rotary member allows the switch actuator of the second electrical switch into its engaged position while preventing the switch actuator of the first electrical switch from being moved into its engaged position, and a second orientation, whereat the rotary member allows the first switch actuator to be moved into its engaged position while preventing the second switch actuator from being moved into its engaged position.

19 Claims, 4 Drawing Sheets

ROTARY INTERLOCK MECHANISM FOR ELECTRICAL SWITCHES

FIELD OF THE INVENTION

The present disclosure relates generally to electrical distribution devices with multiple switches, such as circuit breakers. More particularly, the present disclosure relates to switch interlock mechanisms for preventing two functionally paired switches in an electrical distribution device from being engaged at the same time.

BACKGROUND

In electronics, a switch is an electrical component that can break an electrical circuit, for example, to interrupt the current flow or divert the current from one electrical path to another. One type of electrical switch is the circuit breaker, which is an automatically operated electrical switch designed to electrically engage and disengage a selected circuit from an electrical power supply, for example, to protect the circuit from damage that can be caused by an overload or a short circuit. In general, a circuit breaker detects a fault condition, such as an overcurrent condition, and responsively discontinues electrical flow (i.e., "trips the circuit"), which is typically achieved by opening operating contacts within the circuit breaker to interrupt the current flow. To resume normal operation, the circuit breaker can normally be reset, either manually or automatically. Circuit breakers are manufactured in various sizes and configurations, from small safety breakers that protect an individual household appliance up to large switchgear designs for protecting high voltage circuits which distribute electricity to an entire town.

In many electrical supply systems, there are applications where a circuit must switch between alternate sources of electric power. For instance, many commercial buildings, residential homes, and industrial facilities need the capacity to switch from a standard utility power source to a back-up power generator. A common application of this type of arrangement is known as a "transfer switch." To support these applications, some circuit breaker boxes are designed with separate electrical circuits that are arranged so that when one group of circuits is switched to a conductive state, another group of circuits is switched to a non-conductive state in alternating fashion. In some arrangements, a common load can be alternately switched between separate power sources so that as one power source is disconnected from the load the second power source is connected after a negligible delay.

In many common circuit breaker box designs, the individual breaker switches are packaged such that switches that are connectable to related circuits are arranged in horizontally or vertically opposing in-line pairs. To accomplish a switching operation, such as those described above, one switch is flipped (opened or closed) before a second switch of a functional pair is flipped (closed or opened). In a transfer switch application where the breaker switches are manually operated, the operator will flip the transfer switches by hand, first disconnecting the utility current source from the circuit and then connecting the back-up generator to the circuit (and vice versa). Manually operated breaker switches are typically spring biased so that once a switch handle has reached top dead-center, any slight deflection from that position will cause the switch to continue to the fully switched position, unless otherwise restrained.

Separately acting switches are used in safety circuit breaker assemblies to ensure that the utility current circuitry is disengaged before a separate power source is connected, thereby preventing electricity from being fed back into the utility circuit. In addition, interlock mechanisms have been created that prevent one switch, which engages a first power source, from being closed at the same time a second switch in a functional pair, which engages another power source, is closed. Most interlock mechanisms are comprised of a slidably mounted blocking plate that can be moved rectilinearly between two operating positions. When in the first operating position, the blocking plate prevents a first switch handle from being closed while permitting a second switch handle to be closed. The blocking plate can then be slid to the second operating position, whereat the plate prevents the second switch handle from being closed while allowing the first switch handle to be closed.

Prior art switch interlock mechanisms for in-line opposed switches tend to be unnecessarily complex mechanisms, requiring a large number of components and moving parts to provide the blocking feature. The complexity of such devices increases manufacturing and assembly costs, and creates a higher likelihood of warranty claims for broken devices. In addition, a large amount of packaging space is consumed to accommodate the linear movement of the blocking plate, namely the multiple operating positions. Thus, there is a need for electrical switch interlock mechanisms that prevent multiple switches in a functional group from being engaged at the same time, while not requiring a large number of components or a lot of packaging space to properly operate.

SUMMARY

Rotary interlock mechanisms are disclosed herein that require very few parts, and are therefore inexpensive to manufacture and easy to install. Rotary interlock mechanisms are disclosed herein that feature an ergonomic design that minimizes physical effort and discomfort, and hence maximizes efficiency. Rotary interlock mechanisms are disclosed herein that are completely secure, ensuring that blocked switches are kept disconnected while allowing unblocked switches to be easily connected—i.e., there is no possibility to activate both switches at the same time. Rotary interlock mechanisms are disclosed herein that minimize the amount of packaging space required to properly operate. Rotary interlock mechanisms are disclosed herein that do not require any additional/special tooling to move the mechanism. Rotary interlock mechanisms are disclosed herein that require special tooling to remove the mechanism.

According to some aspects of the present disclosure, an electrical distribution device for distributing power to a load is presented. The electrical distribution device includes at least two electrical switches that are operatively attached to a housing. Each of the electrical switches has a respective switch actuator that is movable between a respective engaged position and a respective disengaged position. A rotary member is rotatably mounted to the housing adjacent the switch actuators of the first and second electrical switches. The rotary member has a body with a receiving portion and a blocking portion. The rotary member is rotatable between first and second orientations. When in the first orientation, the blocking portion prevents one of the switch actuators from being moved into its engaged position, whereas the receiving portion receives the other switch actuator allowing it to be moved into its engaged position. In contrast, when the rotary member is in the second orientation, the blocking portion prevents the other switch actuator from being moved into its engaged position, and the receiving portion receives the one switch actuator allowing it to be moved into its engaged position.

According to other aspects of the present disclosure, a circuit breaker assembly is featured for selectively connecting different power sources to a load. The circuit breaker assembly includes first and second circuit breakers that are operatively mounted to a switch panel in-line and opposed to one another. Each of the circuit breakers is mounted in a respective one of two columns on either side of a medial line between the circuit breakers. Each of the circuit breakers has a respective handle having respective ON and OFF handle positions. The ON handle positions of the opposed circuit breakers pivot toward the medial line, whereas the OFF handle positions of the opposed circuit breaker pivot away from the medial line. A rotating disk is mounted in between the handles of the first and second circuit breakers. An outer peripheral portion of the rotating disk has a slot centered at a zero degree point on the circumference of the rotating disk. The slot is shaped and sized to receive therein one of the breaker handles. Another outer peripheral portion of the rotary member at a 180 degree point on the circumference of the disk is sans a slot capable of receiving therein one of the breaker handles. The rotating disk can be placed in a position where only a selected one of the first and second circuit breaker handles can be moved into the ON position at one time, while a non-selected one of the first and second circuit breaker handles is prevented from being moved into the ON position.

According to other aspects of the present disclosure, a circuit breaker assembly is presented for selectively connecting different power sources to a load. The circuit breaker assembly includes a housing with a switch panel. First and second circuit breakers are mounted to the switch panel adjacent one another. The first circuit breaker has a first toggle switch that is movable along a common plane from a first engaged position, whereat the first circuit breaker electrically couples a first power source to the load, and a first disengaged position, whereat the first circuit breaker disconnects the first power source from the load. The second circuit breaker has a second toggle switch that is movable along the common plane from a second engaged position, whereat the second circuit breaker electrically couples a second power source to the load, and a second disengaged position, whereat the second circuit breaker disconnects the second power source from the load. The circuit breaker assembly also includes a rotary interlock mechanism having a disk-shaped body that is rotatably mounted to the switch panel intermediate the first and second toggle switches. The disk-shaped body has opposing first and second sides, the first side of the disk-shaped body defining a slot configured to individually receive therein the first and second toggle switches. The second side has a blocking wall configured to physically obstruct the first and second engaged positions. The rotary interlock mechanism is selectively rotatable between a first orientation, whereat the blocking wall blocks the first toggle switch from being moved into the first engaged position and the slot receives therein the second toggle switch when moved into the second engaged position, and a second orientation, whereat the blocking wall blocks the second toggle switch from being moved into the second engaged position and the slot receives therein the first toggle switch when moved into the first engaged position.

The above summary is not intended to represent each embodiment or every aspect of the present disclosure. Rather, the foregoing summary merely provides an exemplification of some of the novel features disclosed herein. The above features and advantages, and other features and advantages of the present disclosure, will be readily apparent from the following detailed description of the exemplary embodiments and best modes for carrying out aspects of the present invention when taken in connection with the accompanying drawings and appended claims.

Figure 1:
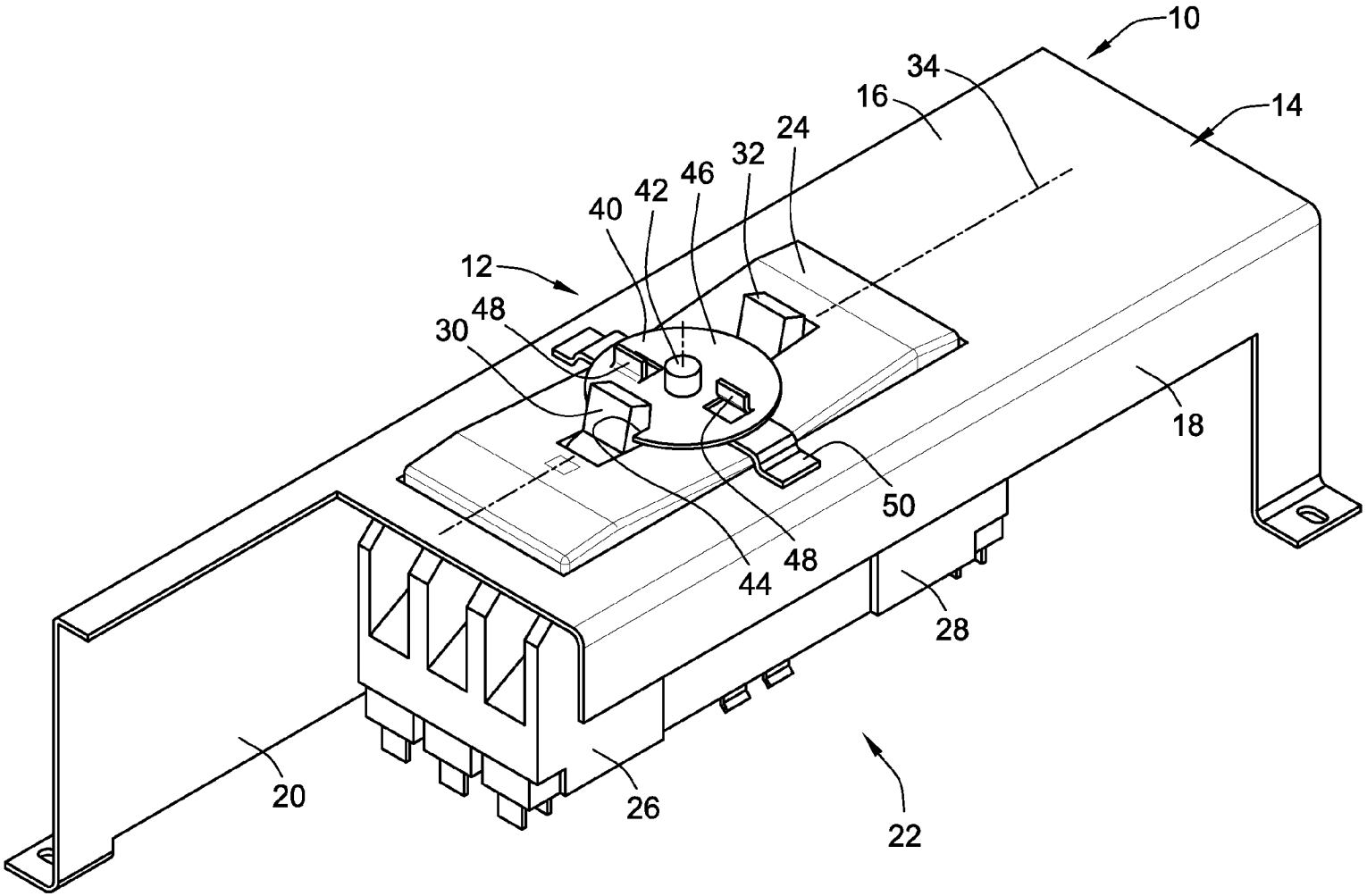
FIG. 1 is an elevated perspective-view illustration of a representative electrical switch assembly with an exemplary rotary interlock mechanism in accordance with embodiments of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION

Referring now to the drawings, wherein like reference numerals refer to like components throughout the several views, FIG. 1 illustrates an exemplary electrical switch assembly, designated generally as 10, with an exemplary rotary interlock mechanism, designated generally as 12, in accordance with embodiments of the present disclosure. It should be understood that the drawings are not necessarily to scale and are provided purely for descriptive purposes; thus, the individual and relative dimensions of the drawings presented herein are not to be considered limiting. Likewise, many of the disclosed concepts are discussed with reference to electrical circuit breaker assemblies; however, the concepts of the present disclosure are not so limited and are just as applicable to any electrical switch assembly having at least two electrical switches. Turning then to FIG. 1, the electrical switch assembly 10 generally includes a housing, designated generally as 14, having a top wall 16 that extends between and connects first and second opposing side walls 18 and 20, respectively. The housing walls 16, 18, 20 cooperate to define an open interior within which is mounted a power distribution base assembly, designated generally as 22 in FIG. 1, which is operable for distributing electricity.

A switch panel 24 extends through an opening in the top wall 16 of the housing 14. A pair of electrical switches, such as first and second circuit breakers 26 and 28, respectively, are mounted to the housing 14. The first circuit breaker 26 includes a switch actuator, presented in the form of a first toggle switch 30, which is movable between respective engaged and disengaged positions. The second circuit breaker 28 also includes a switch actuator, which is presented in the form of a second toggle switch 32, that is movable between respective engaged and disengaged positions. In the illustrated embodiment, the first and second circuit breakers 26, 28 are mounted adjacent one another such that the first and second toggle switches 30, 32 are operatively aligned along a common plane (shown for illustrative purposes at 34) in spaced relation to one another for pivoting in a substantially parallel manner between respective engaged and disengaged positions. When in the first engaged position, the first toggle switch 30 pivots along the common plane 34 towards the second toggle switch 32 (i.e., generally to the right in FIG. 1), and pivots away from the second toggle switch 32 (i.e., generally to the left in FIG. 1) when in the first disengaged position. By way of comparison, the second toggle switch 32 pivots towards the first toggle switch 30 (i.e., generally to the left in FIG. 1) when in the second engaged position, and pivots away from the first toggle switch 30 (i.e., generally to the right in FIG. 1) when in the second disengaged position.

The number, orientation, and means for activating the electrical switches may be varied, individually, collectively, and in any combination, from what is shown in FIG. 1 without departing from the intended scope and spirit of the present disclosure. For instance, the rotary interlock mechanism 12 may be readily modified to functionally operate with more than two switches, as discussed in further derail below. Moreover, each of the electrical switches may be activated by means other than a toggle switch, such as a push-button switch or a rocker switch. To that end, the toggle switches need not be operatively aligned along a common plane for pivoting between respective engaged and disengaged positions; rather, the toggle switches may be angularly offset from one another.

According to some configurations, the electrical switch assembly 10 operates as a transfer switch. In this instance, the first breaker switch 26 can be a primary main breaker, which is movable between ON and OFF positions: when in the engaged or ON position, the primary main breaker distributes power from a primary power source, such as a standard utility power source, to a load; and, when in the disengaged or OFF position, the primary main breaker functions to cut off the supply of power from the primary power source. The second breaker switch 28 can be an auxiliary main breaker, which is movable between ON and OFF positions: when in the engaged or ON position, the auxiliary main breaker distributes power from an auxiliary power source, such as a back-up power generator, to the load; and, when in the disengaged or OFF position, the auxiliary main breaker functions to cut off the supply of power from the auxiliary power source.

In accordance with an aspect of the present disclosure, the electrical switch assembly 10 also includes a rotary interlock mechanism 12. In general, the rotary interlock mechanism 12 includes a rotary member 40 that is configured to rotatably mount to the housing 14 adjacent the first and second electrical switches 26, 28 to allow only one of the switches 26, 28 to be moved into the ON position at one time. In the present embodiment, it will be appreciated that both of the switches can be in the OFF position at one time (see, e.g., FIG. 2). The rotary member 40 is rotatable between a first orientation, which may be denominated zero degrees, whereat the rotary member 40 prevents the switch actuator 30 of the first electrical switch 26 from being moved into the first engaged position, and a second orientation, which may be denominated 180 degrees, whereat the rotary member prevents the switch actuator 32 of the second electrical switch 28 from being moved into the second engaged position. When in the first orientation, the rotary member 40 only allows the switch actuator 32 of the second electrical switch 28 to be moved into its engaged position. In contrast, when in the second orientation, the rotary member 40 only allows the switch actuator 30 of the first electrical switch 26 to be moved into its engaged position.

In the illustrated example, the rotary interlock mechanism 40 has a disk-shaped body that is rotatably mounted to the bracket 50, e.g., via fastener 42, approximately halfway between the first and second toggle switches 30, 32. As seen in FIG. 1, the outer-most diameter of the disk-shaped body is greater than the distance between the first and second toggle switches 30, 32. The disk-shaped body has opposing first and second sides; the first side of the disk-shaped body includes a slot 44 that is shaped and sized to individually receive therein the first and second toggle switches 30, 32. The second side of the disk-shaped body, in contrast, has a blocking wall 46, which extends over and physically obstructs the first or the second engaged position of the first and second toggle switches 30, 32, respectively.

Although shown with a single slot 44, the rotary interlock mechanism 40 can be fabricated with multiple slots 44 without departing from the intended scope and spirit of the present disclosure. For example, the rotary interlock mechanism 40 can include two slots 44 that are offset 90 degrees from each other. By incorporating an additional slot 44, the rotary interlock mechanism 40 can operate with two functional pairs of electrical switches, allowing one electrical switch in each pair to be ON, while preventing one of the electrical switches in each pair from being moved into an ON position.

Figure 2:
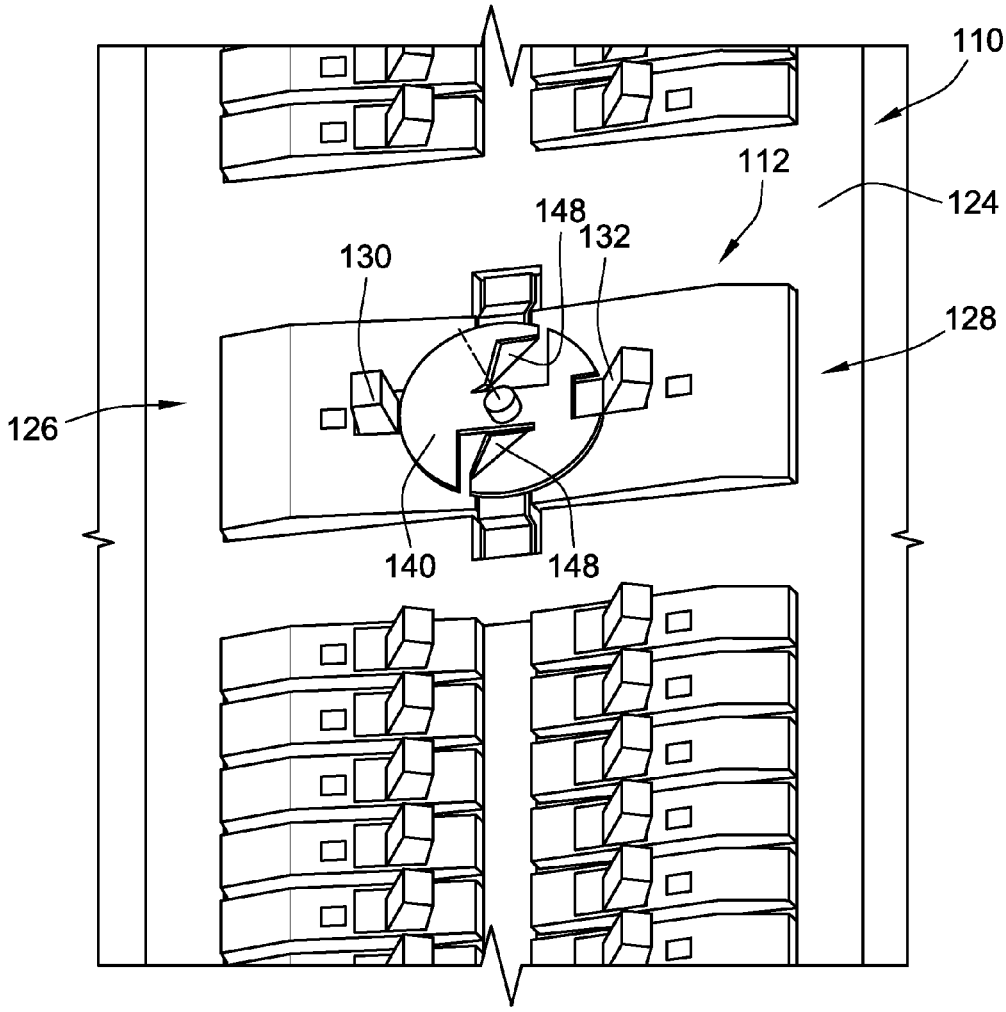
FIG. 2 is a perspective-view illustration of a portion of a representative circuit breaker assembly with another exemplary rotary interlock mechanism in accordance with embodiments of the present disclosure.

When the rotary interlock mechanism 40 is in the first orientation, as seen for example in FIG. 2, the first circuit breaker 26 is precluded from being activated because the blocking wall 46 physically obstructs the first engaged position thereby preventing the first toggle switch 30 from being moved into the first engaged position. Contrastingly, the second circuit breaker 28 can be activated when the rotary interlock mechanism 40 is in the first orientation because the slot 44 receives therein the second toggle switch 32 allowing the second toggle switch 32 to be moved into the second engaged position. By way of comparison, when the rotary interlock mechanism 40 is in the second orientation, as seen for example in FIG. 1, the second circuit breaker 28 is precluded from being activated because the blocking wall 46 physically obstructs the second engaged position thereby preventing the second toggle switch 32 from being moved into the second engaged position. In contrast, the first circuit breaker 26 can be activated when the rotary interlock mechanism 40 is in the second orientation because the slot 44 receives therein the first toggle switch 30 allowing the first toggle switch 30 to be moved unimpeded into the first engaged position.

In the illustrated embodiment, the rotary interlock mechanism 12 can be transitioned between the first and second orientations by turning the rotary member 40 in the clockwise or the counterclockwise direction. In some embodiments, the rotary member 40 can be turned in only a clockwise or a counterclockwise direction. In the illustrated embodiment, the position of the rotary member 40 relative to the housing 14 remains unchanged when the rotary member 40 rotates between the different operating orientations. The design of the rotary interlock mechanism 12 is intended to be intuitive; thus, there is generally no need for features to align the rotary member 40 with the toggle switches 30, 32. In some embodiments, however, the rotary interlock mechanism 12 includes alignment features, such as raised tabs or visual indicators, for operatively aligning the rotary member 40 with the toggle switches 30, 32.

The rotary interlock mechanism 12 can be mounted to the electrical switch assembly 10 in a variety of different ways. In FIG. 1, for example, the rotary member 40 is rotatably fastened to the housing 14 via a rivet 42, which is received in a complementary hole in an elongated mounting bracket 50, which is rigidly mounted to the top wall 16 of the housing 14.

Figure 3:
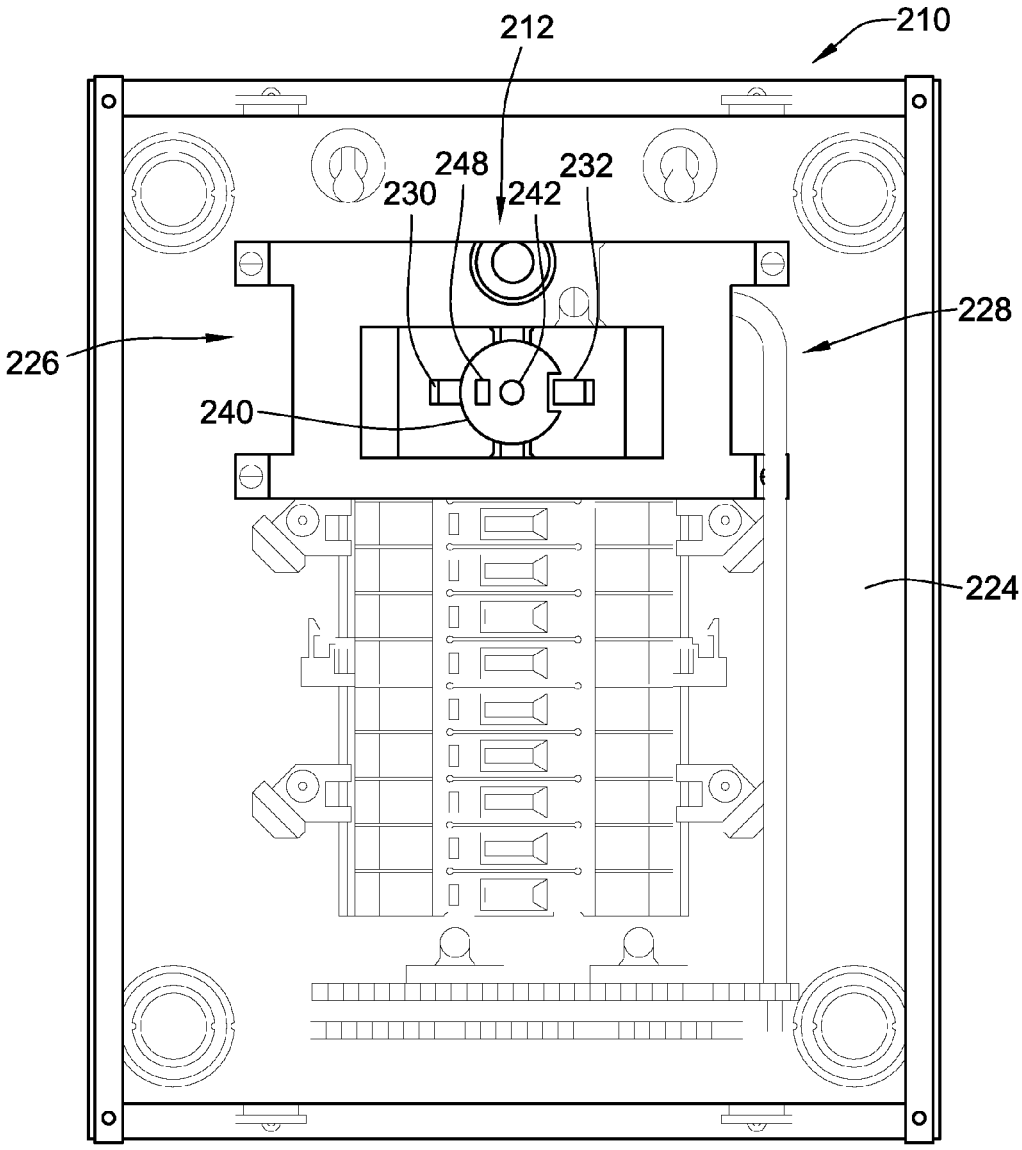
FIG. 3 is a plan-view illustration of another representative circuit breaker assembly with another exemplary rotary interlock mechanism in accordance with embodiments of the present disclosure.

In some applications, the mounting bracket 50 is unnecessary, and therefore can be eliminated from the rotary interlock assembly. By way of non-limiting example, FIG. 3 illustrates a representative circuit breaker assembly, designated generally as 210, with an exemplary rotary interlock mechanism, designated generally as 212. The circuit breaker assembly 210 includes a plurality of electrical circuit breakers, represented herein by first and second circuit breakers 226 and 228, respectively, that are mounted to a switch panel 124. The first circuit breaker 226 includes a first toggle switch 230 that is movable between respective engaged and disengaged positions, while the second circuit breaker 228 includes a second toggle switch 232 that is movable between respective engaged and disengaged positions. The rotary interlock mechanism 212 of FIG. 3 includes a rotary member 240 that is rotatably mounted to the housing 212 in between the first and second toggle switches 230, 232. In contrast to the embodiment of FIG. 1, the rotary member 240 of FIG. 3 is rotatably fastened directly to the switch panel 224, e.g., via a rivet 242. That is, a complementary bore hole (not visible in the view provided) is fabricated in the switch panel 224. The buck-tail end of the rivet 224 is passed through the complementary bore hole in the switch panel 224, and then deformed so that it expands, holding the rivet in place.

Figure 4:
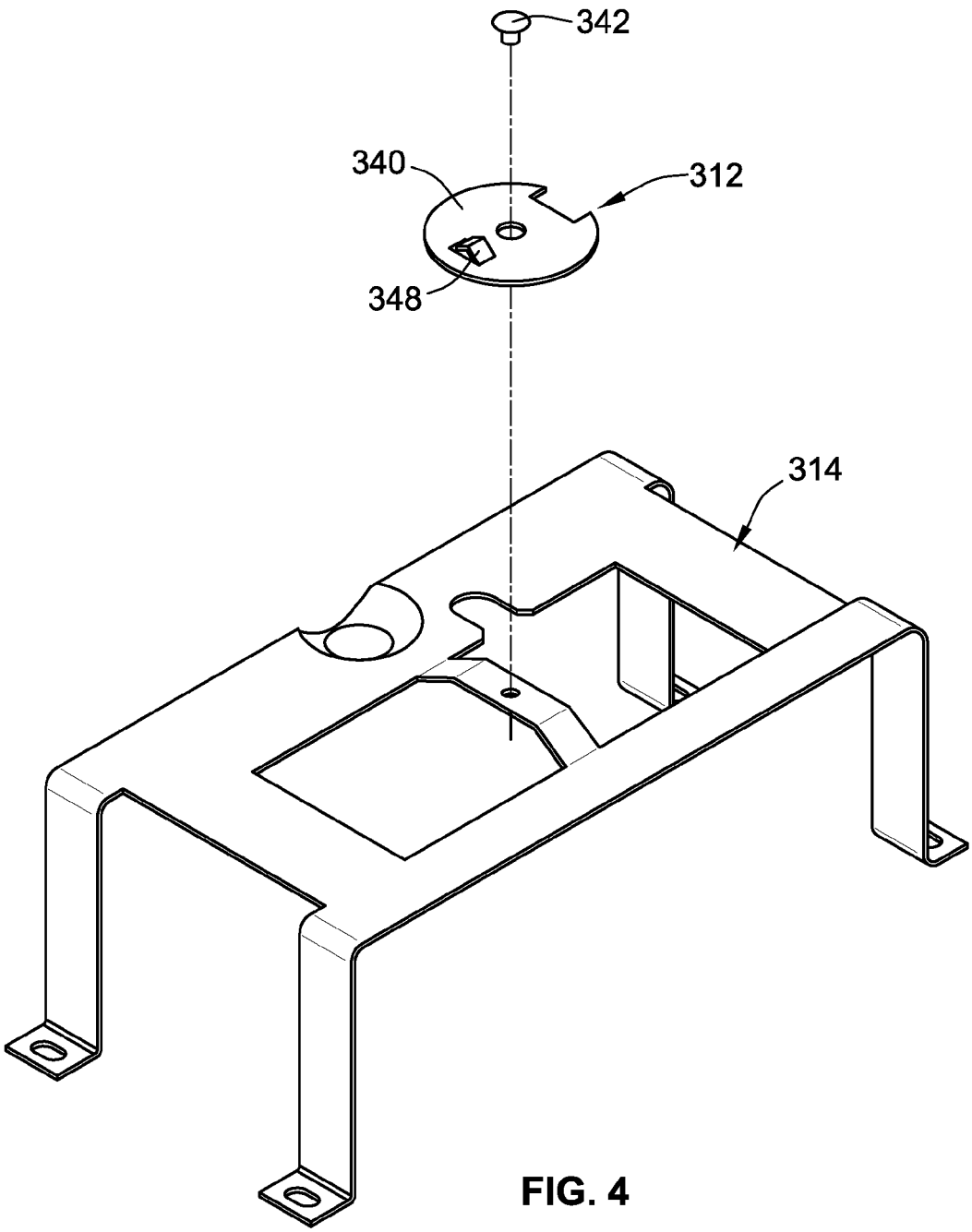
FIG. 4 is an exploded perspective-view illustration of an exemplary rotary interlock mechanism in accordance with embodiments of the present disclosure.

One or more optional protrusions 48 project from an upper surface of the rotary member 40. In FIG. 1, for example, the rotary member 40 includes two protrusions 48, each of which is a square-shaped, radially oriented flange that was stamped out of the disk-shaped body and extends generally perpendicularly from the rotary member 40. The protrusions 48 facilitate rotating the rotary member 40 between the first and second orientations by providing gripping surfaces for the operators fingers. In another example, FIG. 2 illustrates a representative circuit breaker assembly, designated generally as 110, with an exemplary rotary interlock mechanism, designated generally as 112. The circuit breaker assembly 110 includes a plurality of electrical circuit breakers, represented herein by first and second circuit breakers 126 and 128, respectively, that are mounted to a switch panel 124. The first circuit breaker 126 includes a first toggle switch 130 that is movable between respective engaged and disengaged positions, while the second circuit breaker 128 includes a second toggle switch 132 that is movable between respective engaged and disengaged positions. The rotary interlock mechanism 112 of FIG. 2 includes a rotary member 140 that is rotatably mounted to the housing 112 in between the first and second toggle switches 130, 132. In contrast to the embodiment of FIG. 1, the rotary member 140 of FIG. 2 includes two protrusions 148, each of which is a triangle-shaped, radially offset flange that was stamped out of and extends generally perpendicularly from the rotary member 140. In an alternative configuration, the rotary member 240 of FIG. 3 includes a single protrusion 248, which is a rectangular tab that is mechanically fastened or otherwise attached to the top surface of the rotary member 240. Alternatively, FIG. 4 illustrates another exemplary rotary interlock mechanism, designated generally as 312, in accordance with the aspects of the present disclosure. In this embodiment, the rotary interlock mechanism 312 consists of a disk-shaped rotary member 340 that is rotatably fastened to a housing bracket 314 via a single rivet 342. In contrast to FIGS. 1-3, the rotary member 340 of FIG. 4 includes a single protrusion 348, which is a raised surface that was stamped out of the disk-shaped rotary member 340.

The rotary interlock mechanisms disclosed herein are amenable to a variety of variations and modifications. For example, although illustrated throughout the drawings as a generally flat, circular disk-shaped part, the rotary member can take on a variety of alternative shapes, such as elliptical, polygonal, oblong, etc., and geometries, such as cylindrical, frustoconical, etc. Moreover, the rotary member can be operatively attached to the housing by various alternative means, such as a nut-and-bolt combination, a bushing, a bearing, or a threaded screw. To that end, the attachment means need not be a separate component, but may be integrally formed with the rotary member. For example, the rotary member can be preformed with a male snap-fastener feature that protrudes from one side of the rotary member. As yet another example, the rotary member can be modified to replace the slot 44 with a flat edge which abuts against a respective switch actuator when the switch actuator is moved into an engaged position.

An advantage of some of the disclosed aspects is that the rotary interlock mechanism requires very few parts (as few as two in some designs), and is therefore inexpensive to manufacture and easy to install. To that end, the rotary interlock mechanism can be fabricated in a single punch-and-die operation, which reduces material costs and minimizes production time and costs. In addition, some designs only require a single rivet to attach the rotary interlock mechanism to the switch assembly, further reducing manufacturing costs and simplifying the assembly process, which in turn reduces assembly time and labor costs. Another advantage of using a rivet, in comparison with threaded fasteners, is the reduction in friction between the attachment interface and the interlock plate, which minimizes the requisite operating force and, consequently, facilitates the blocking interchange movement.

Another advantage of some of the disclosed aspects is that the rotary interlock mechanism features an ergonomic design that minimizes physical effort and discomfort, and hence maximizes efficiency. For example, the ergonomic design of the rotary interlock mechanism allots for a wider tolerance (e.g., margin or error) when changing switches. In particular, slidably mounted blocking plates require precise alignment of the plate with the electrical switches for proper operation. In contrast, some of the disclose aspects merely require the rotary interlock mechanism be generally aligned with the functionally paired electrical switches to allow the operator to change active switches. In addition, operation of the rotary interlock mechanism is intuitive, and therefore requires no special training, which minimizes the possibility of improper usage.

An advantage of some of the disclosed aspects is that the rotary interlock mechanisms are completely secure, ensuring that blocked switches are kept disconnected while allowing unblocked switches to be easily connected. Another advantage is that the rotary interlock mechanisms minimize the amount of packaging space required to properly operate. While slidable interlock plates require additional packaging space to accommodate multiple operating positions, the rotary interlock mechanism does not change position relative to the housing and therefore does not require additional packaging space for proper operation. Another advantage over the prior art is that the some of the disclosed designs do not require additional tooling or special tooling to properly operate. Moreover, some designs require special tooling to remove the interlock mechanism from the switch assembly, ensuring that the interlock mechanism is secure and cannot be easily tampered with.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims. To that extent, elements and limitations that are disclosed, for example, in the Abstract, Summary, and Detailed Description sections, but not explicitly set forth in the claims, should not be incorporated into the claims, singly or collectively, by implication, inference, or otherwise.

What is claimed is:

1. A circuit breaker assembly for selectively connecting different power sources to a load, the circuit breaker assembly comprising:

first and second circuit breakers operatively mounted to a switch panel in-line and opposed to one another, each of the circuit breakers being mounted in a respective one of two columns on either side of a medial line between the circuit breakers, each of the circuit breakers having a respective handle having respective ON and OFF handle positions, wherein the ON handle positions of the opposed circuit breakers pivot toward the medial line, and the OFF handle positions of the opposed circuit breakers pivot away from the medial line; and a rotating disk mounted in between the handles of the first and second circuit breakers, an outer peripheral portion of the rotating disk defining a slot centered at a zero degree point on the circumference of the rotating disk, the slot being shaped and sized to receive therein one of the breaker handles, another outer peripheral portion of the rotary member at a 180 degree point on the circumference of the disk being without a slot capable of receiving therein one of the breaker handles, whereby the rotating disk can be placed in a position where only a selected one of the first and second circuit breaker handles can be moved into the ON position at one time while a non-selected one of the first and second circuit breaker handles is prevented from being moved into the ON position.

2. A circuit breaker assembly for selectively connecting different power sources to a load, the circuit breaker assembly comprising:

a housing with a switch panel;

a first circuit breaker mounted to the switch panel, the first circuit breaker having a first toggle switch movable along a common plane from a first engaged position, whereat the first circuit breaker electrically couples a first power source to the load, and a first disengaged position, whereat the first circuit breaker disconnects the first power source from the load;

a second circuit breaker mounted to the switch panel adjacent the first circuit breaker, the second circuit breaker having a second toggle switch in-line with and opposing the first toggle switch, the second toggle switch being movable along the common plane from a second engaged position, whereat the second circuit breaker electrically couples a second power source to the load, and a second disengaged position, whereat the second circuit breaker disconnects the second power source from the load; and a rotary interlock mechanism having a disk-shaped body rotatably mounted to the switch panel intermediate the first and second toggle switches, the disk-shaped body having opposing first and second sides, the first side of the disk-shaped body defining a slot at a zero degree point on the circumference of the rotary interlock mechanism, the slot being configured to individually receive therein the first and second toggle switches, and the second side having a blocking wall at a 180 degree point on the circumference of the rotary interlock mechanism, the blocking portion being configured to physically obstruct the first and second engaged positions, wherein the rotary interlock mechanism is selectively rotatable between a first orientation, whereat the blocking wall blocks the first toggle switch from being moved into the first engaged position and the slot receives therein the second toggle switch when moved into the second engaged position, and a second orientation, whereat the blocking wall blocks the second toggle switch from being moved into the second engaged position and the slot receives therein the first toggle switch when moved into the first engaged position.

3. An electrical distribution device for distributing power to a load, the electrical distribution device comprising:

a housing;

first and second electrical switches operatively attached to the housing, each of the electrical switches having a respective switch actuator movable between respective engaged and disengaged positions; and a rotary member rotatably mounted to the housing adjacent the switch actuators of the first and second electrical switches, the rotary member having a body with a receiving portion and a blocking portion, the body of the rotary member being disk-shaped and rotatably mounted to the housing in between the switch actuators of the electrical switches, an outer peripheral portion of the disk-shaped body defining the receiving portion at a zero degree point on the circumference of the rotating member, and another outer peripheral portion of the disk-shaped body defining the blocking portion at a 180 degree point on the circumference of the rotary member, wherein the rotary member is rotatable between a first orientation, whereat the blocking portion prevents one of the switch actuators from being moved into the engaged position and the receiving portion receives the other one of the switch actuators when moved into the engaged position, and a second orientation, whereat the blocking portion prevents the other one of the switch actuators from being moved into the engaged position and the receiving portion receives the one of the switch actuators when moved into the engaged position.

4. The electrical distribution device of claim 1, wherein the switch actuators include first and second toggle switches that pivot along a common plane between respective engaged and disengaged positions, and wherein the rotary member body is rotatably mounted on the common plane in between the toggle switches.

5. The electrical distribution device of claim 4, wherein a diameter of the disk-shaped body is greater than a distance between the switch actuators of the first and second electrical switches.

6. The electrical distribution device of claim 4, wherein the first toggle switch, when moving into the first engaged position, pivots along the common plane towards the second toggle switch and, when moving into the first disengaged position, pivots away from the second toggle switch.

7. The electrical distribution device of claim 6, wherein the second toggle switch, when moving into the second engaged position, pivots along the common plane towards the first toggle switch and, when moving into the second disengaged position, pivots away from the first toggle switch.

8. The electrical distribution device of claim 1, wherein the receiving portion is a slot defined in the outer peripheral portion of the rotary member body, the slot being configured to receive therein the switch actuator of the second electrical switch when the rotary member is in the first orientation, and receive therein the switch actuator of the first electrical switch when the rotary member is in the second orientation.

9. The electrical distribution device of claim 1, wherein the receiving portion is a slot configured to individually receive therein the switch actuators, and the blocking portion is a blocking wall configured to physically obstruct the engaged positions of the switch actuators.

10. The electrical distribution device of claim 9, wherein, when the rotary member is in the first orientation, the blocking wall blocks the switch actuator of the first electrical switch from being moved into the respective engaged position and the slot receives therein the switch actuator of the second electrical switch when moved into the respective engaged position, and when the rotary member is in the second orientation, the blocking wall blocks the switch actuator of the second electrical switch from being moved into the respective engaged position and the slot receives therein the switch actuator of the first electrical switch when moved into the respective engaged position.

11. The electrical distribution device of claim 1, wherein the position of the rotary member relative to the housing remains unchanged when the rotary member rotates between the first and second orientations.

12. The electrical distribution device of claim 1, wherein the rotary member includes one or more protrusions projecting from a surface of the disk, the protrusions being configured to facilitate rotating the rotary member between the first and second orientations.

13. The electrical distribution device of claim 1, further comprising a rivet configured to rotatably mount the rotary member to the housing.

14. The electrical distribution device of claim 1, further comprising a mounting bracket configured to rotatably mount the rotary member to the housing.

15. The electrical distribution device of claim 1, wherein each of the switch actuators of the first and second electrical switches includes a toggle switch.

16. The electrical distribution device of claim 1, wherein the rotary member consists essentially of the disk-shaped body and a rivet configured to rotatably mount the disk-shaped body to the housing.

17. The electrical distribution device of claim 1, wherein the first and second electrical switches include first and second circuit breakers mounted to the housing in-line and opposed to one another.

18. The electrical distribution device of claim 1, wherein receiving portion is a slot shaped and sized to receive therein one of the switch actuators, and the blocking portion is without a slot capable of receiving therein one of the breaker handles.

19. The electrical distribution device of claim 1, wherein the rotary member includes a plurality of protrusions projecting from a surface of the disk, the protrusions being configured to facilitate rotating the rotary member between the first and second orientations.

* * * * *